United States Patent [19]

Dimon

[11] Patent Number: 5,000,726

[45] Date of Patent: Mar. 19, 1991

[54] METHOD OF MAKING A HANDBAG

[76] Inventor: Martha V. Dimon, 7241 Bosque Rd., Canutillo, Tex. 79835

[21] Appl. No.: 484,989

[22] Filed: Feb. 26, 1990

[51] Int. Cl.[5] ..... B31B 41/00

[52] U.S. Cl. ..... 493/51; 493/267; 493/84; 493/88; 493/384; 493/383

[58] Field of Search ..... 493/51, 84, 88, 89, 493/901, 384, 383, 267; 12/142 C; 36/18, 19, 21; 112/262.1

[56] References Cited

U.S. PATENT DOCUMENTS 3,866,647 2/1975 Tarkowski ..... D3/44

*Primary Examiner*—Frederick R. Schmidt
*Assistant Examiner*—Jack Lavinder
*Attorney, Agent, or Firm*—Leon Gilden

[57] ABSTRACT

A handbag is assembled wherein a right and left side silhouette blank are initially severed from a web, wherein a separate sole and a tongue are also provided, wherein the tongue utilizes a plurality of slots directed interiorly of a forward edge of the tongue to permit securement of sides of the tongue to upper sides of the blanks. A forward slot is formed in the tongue between the spaced slots for selectively receiving a support belt therethrough. Upon assemblage, a separate sole pocket is formed utilizing an upper and lower layer with a zipper sewn into a side wall of the thusly formed pocket, and wherein an upper interior surface of the sole is formed with a coextensive layer of hook and loop fasteners to secure the sole pocket selectively thereto.

5 Claims, 5 Drawing Sheets

METHOD OF MAKING A HANDBAG

BACKGROUND OF THE INVENTION

1. Field of the Invention

The field of the invention relates to handbag organizations, and more particularly pertains to a new and improved method of making a handbag wherein the same selectively secures separate blanks together to form the handbag structure.

2. Description of the Prior Art

Handbag organizations of various types have been provided in the prior art. Heretofore, the prior art has produced handbag structures of relative complex organizations to provide a finished product available as a handbag. The organization of the instant invention provides a method of making a handbag to provide a novelty device for the benefit and amusement of individuals. Examples of the prior art include U.S. Pat. No. 3,866,647 to Tarkowski providing a purse structure in the configuration of pants formed with a zippered closure and the like to provide access to an interior compartment of the pants for use as a purse.

U.S. Pat. No. Des. 263,648 to Schimmel; U.S. Pat. No. Des. 267,369 to Blanchard; U.S. Pat. No. Des. 224,728 to Franitza; and U.S. Pat. No. Des. 251,575 to Molinari, et al., are further examples of various configurations of handbag structures in the form of novelty items such as pants, shoes, and the like.

As such, it may be appreciated that there continues to be a need for a new and improved method of making a handbag wherein the same addresses both the problems of ease of construction of the organization, as well as effectiveness in its application upon completion of the product and in this respect, the present invention substantially fulfills this need.

SUMMARY OF THE INVENTION

In view of the foregoing disadvantages inherent in the known types of handbag organizations now present in the prior art, the present invention provides a method of making a handbag wherein the same utilizes readily securable blanks to form a final handbag product. As such, the general purpose of the present invention, which will be described subsequently in greater detail, is to provide a new and improved method of making a handbag which has all the advantages of the prior art handbag organizations and none of the disadvantages.

To attain this, the present invention provides an assemblage of a handbag wherein a right and left side silhouette blank are initially severed from a web, wherein a separate sole and a tongue are also provided, wherein the tongue utilizes a plurality of slots directed interiorly of a forward edge of the tongue to permit securement of sides of the tongue to upper sides of the blanks. A forward slot is formed in the tongue between the spaced slots for selectively receiving a support belt therethrough. Upon assemblage, a separate sole pocket is formed utilizing an upper and lower layer with a zipper sewn into a side wall of the thusly formed pocket, and wherein an upper interior surface of the sole is formed with a coextensive layer of hook and loop fasteners to secure the sole pocket selectively thereto.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved method of making a handbag which has all the advantages of the prior art handbag structures and none of the disadvantages.

It is another object of the present invention to provide a new and improved method of making a handbag which may be easily and efficiently manufactured and marketed.

It is further object of the present invention to provide a new and improved method of making a handbag which is of a durable and reliable construction.

An even further object of the present invention is to provide a new and improved method of making a handbag which is susceptible of a low cost of manufacture with regard to both materials and labor, and which accordingly is then susceptible of low prices of sale to the consuming public, thereby making such methods of making a handbag economically available to the buying public.

Still yet another object of the present invention is to provide a new and improved method of making a handbag which provides in the apparatuses and methods of the prior art some of the advantages thereof, while simultaneously overcoming some of the disadvantages normally associated therewith.

Still another object of the present invention is to provide a new and improved method of making a handbag wherein the same provides for a readily assembled series of components formed to produce a final product with a separable pocket mounted within the handbag compartment defined by the assembled blanks.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an orthographic side view taken in elevation of an exterior surface of the assembled right and left handbag blanks in a back-to-back relationship.

FIG. 7 is an orthographic top view of stages of construction of the tongue of the instant invention.

FIG. 10 is an isometric illustration of the instant invention in a completed configuration.

DESCRIPTION OF THE PREFERRED EMBODIMENT

Figure 1:
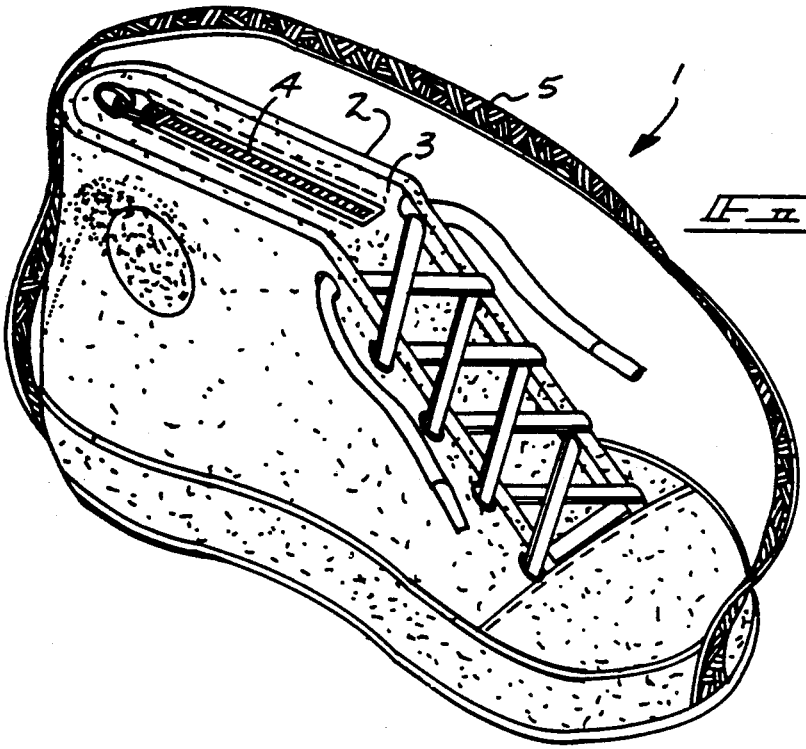
Fig 1 PRIOR ART
FIG. 1 is an isometric illustration of a prior art handbag organization.
Figure 2:
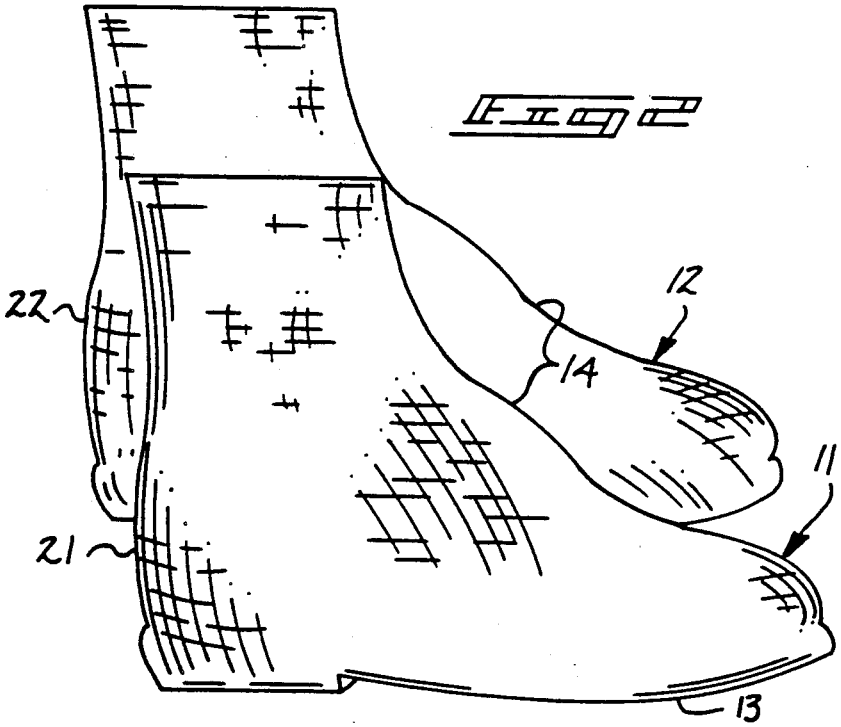
FIG. 2 is an orthographic side view taken in elevation of the right and left handbag blanks utilized by the instant invention.

With reference now to the drawings, and in particular to FIGS. 1 to 10 thereof, a new and improved method of making a handbag embodying the principles and concepts of the present invention and generally designated by the reference numeral 10 will be described.

FIG. 1 illustrates a prior art purse construction configured as a shoe incorporating spaced sides 2 with a forward lace work and a top zipper directed to an interior cavity of the purse, with a carrying strap 5 in a surrounding relationship relative to the structure mounted to a forward rearward end thereof.

Figures 3, 4A:
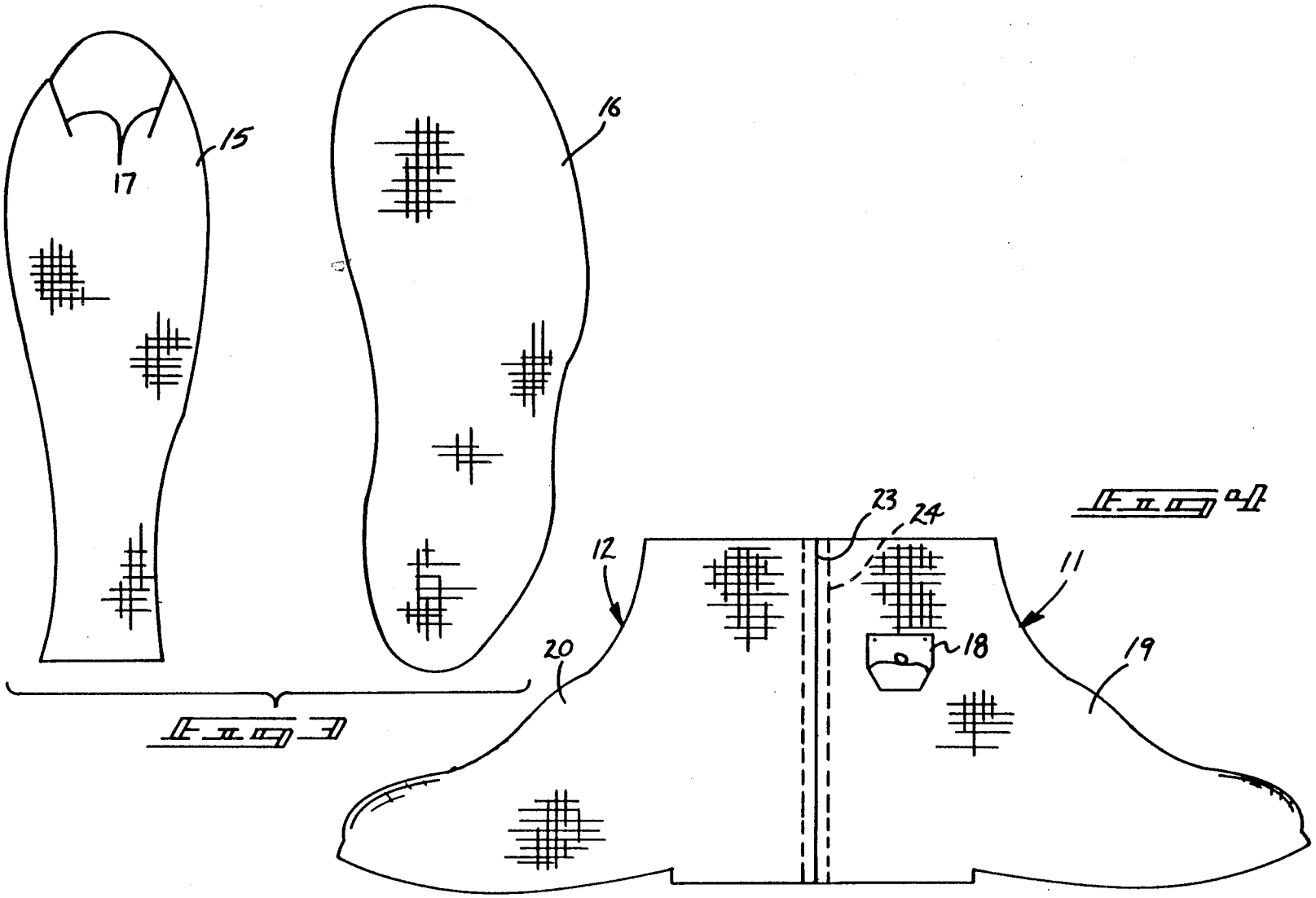
FIG. 3 is a top orthographic view of the tongue and sole structure utilized by the instant invention.

More specifically, the method of making a handbag 10 of the instant invention essentially comprises a right side shoe silhouette blank 11 and a left side shoe silhouette blank 12 removed from a single or separate web of material that may include polymerics and natural fibers. Each blank 11 and 12 includes an elongate sole bottom edge 13, with an elongate shoe upper edge 14 defining the blank with each blank including a respective left and right rear edge 21 and 22 respectively of the respective right and left blanks 11 and 12. FIG. 3 illustrates the flexible shoe tongue 15 formed from a web of material, including spaced slits 17 arranged at an acute angle relative to one another and directed through opposed sides adjacent a forward end of the tongue, wherein a flexible shoe sole 16 is provided for securement to the blanks 11 and 12 to form a bottom portion of the formed handbag.

Figure 5:
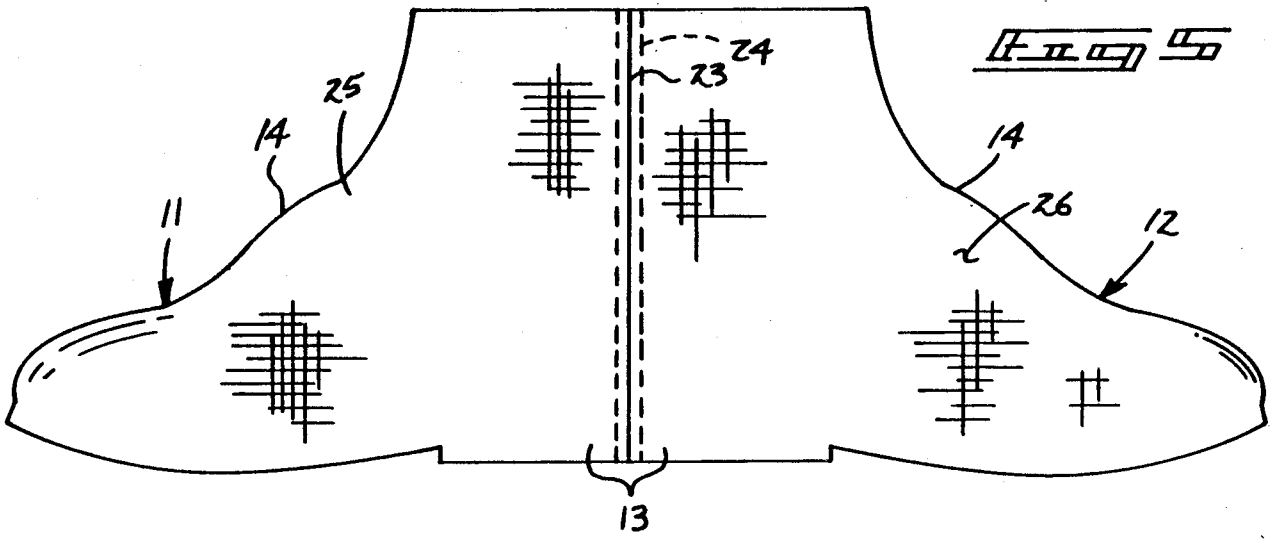
FIG. 5 is an orthographic side view taken in elevation of an interior surface of the handbag blanks, as illustrated in FIG. 4.
Figure 6:
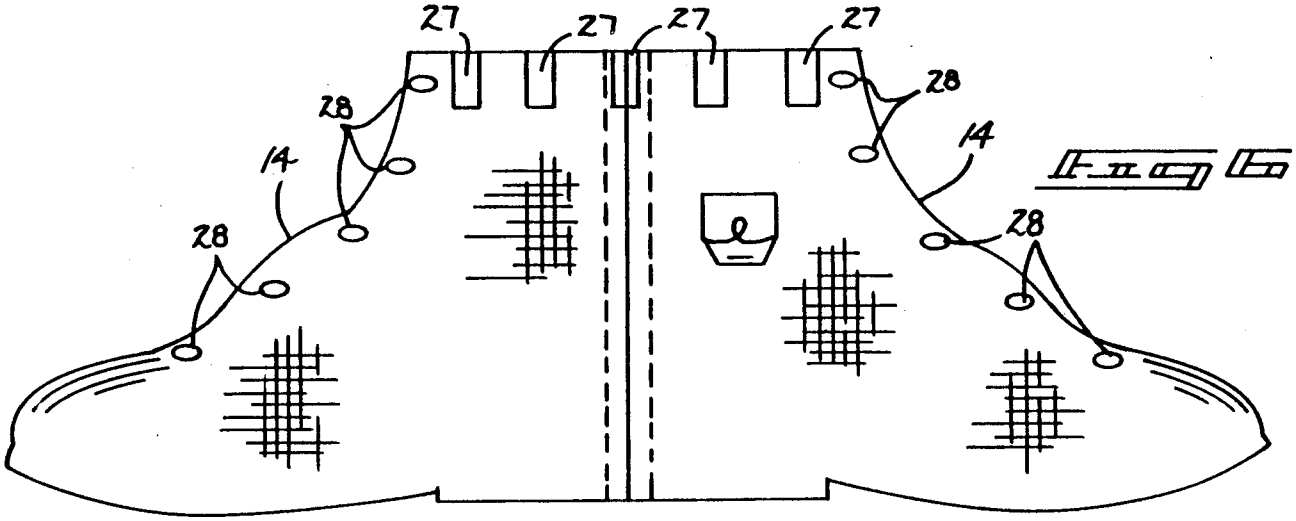
FIG. 6 is an orthographic side view of an exterior surface of the handbag blanks formed with associated exterior pockets and lace apertures.
Figure 11:
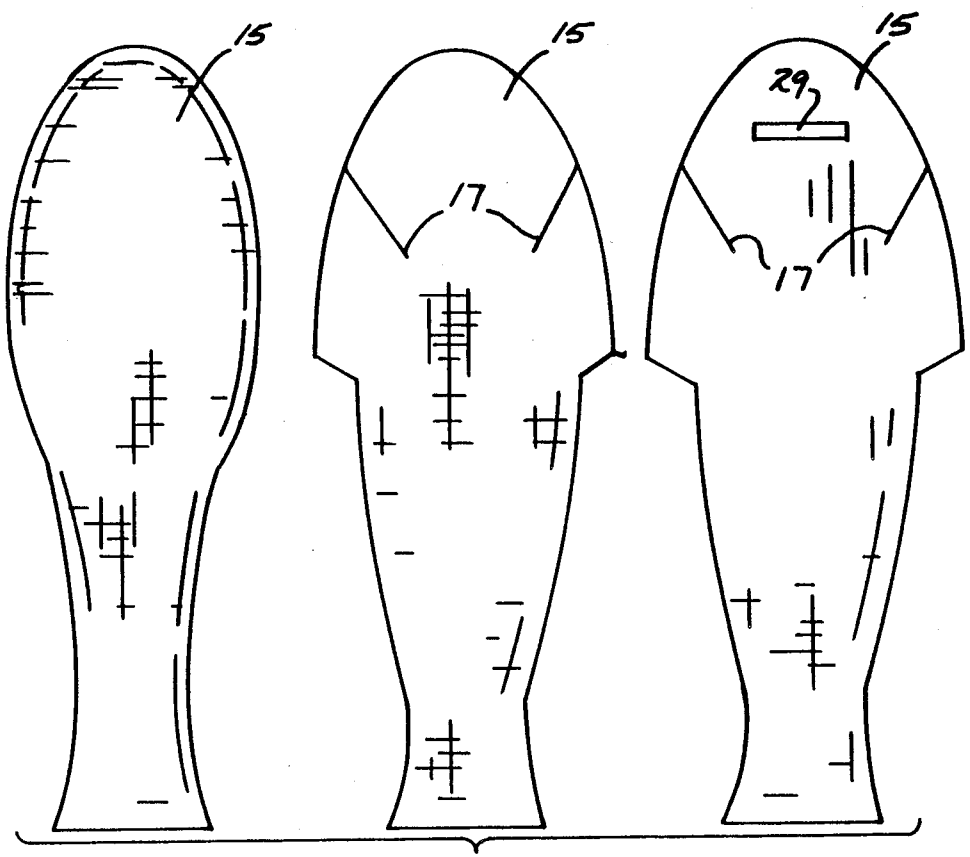
Figure 8:
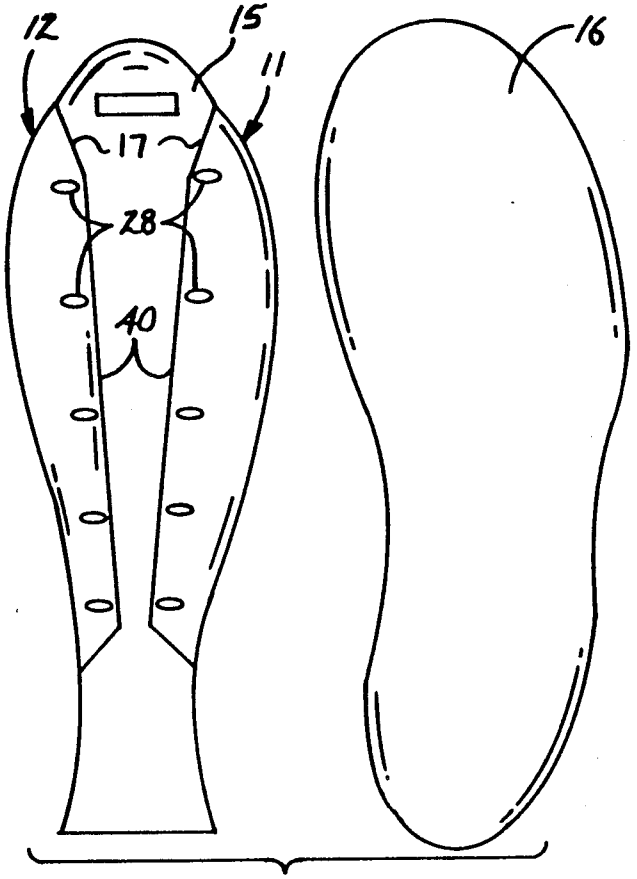
FIG. 8 is an orthographic top view of the tongue assembled to the right and left blanks, as well as the sole structure defining the footprint configuration of the instant invention.
Figure 11:
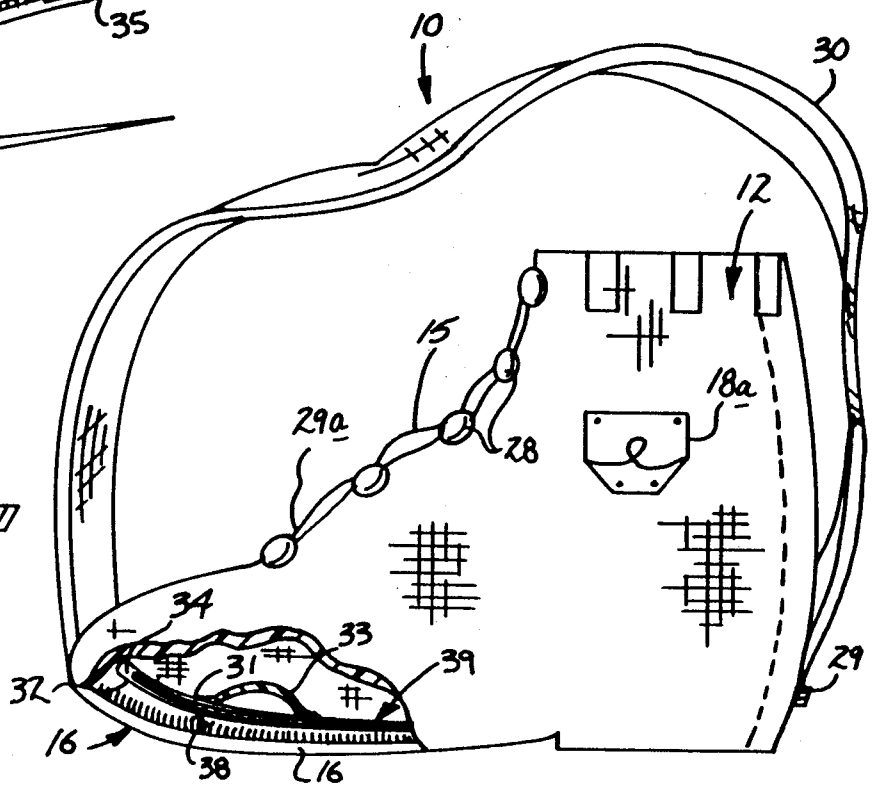

The right and left blanks 11 and 12 are sewn together in an edge-to-edge relationship at the right and left rear edges 21 and 22 respectively to define a single border 23 therebetween. FIG. 4 illustrates the respective exterior surfaces 19 and 20 of the respective right and left blanks, with a right outside pocket formed to the right exterior surface 19. A seam path 24 is formed parallel to and to either side of the single border 23 to define a limited width seam forming the rear end of the handbag construction. FIG. 5 illustrates the single border 23 and the seam path 24, as illustrated from the respective right and left inside surfaces 25 and 26 of respective right and left blanks 11 and 12. Upon formation of the single border 23, pockets 27 for securement of labels and the like are formed downwardly from a top end of the respective right and left blanks 11 and 12, as well as the formation of lace apertures 28 along the respective elongated shoe upper edges 14. FIG. 8 illustrates the tongue 15 mounted to the right and left blanks 11 and 12 utilizing a tongue seam 40 formed along the spaced slit 17 extending rearwardly thereof in securing the tongue seam to the right and left blanks 11 and 12 respectively, wherein the rearwardmost end of the tongue 15 extends rearwardly and beyond the right and left blanks, as illustrated.

Figure 9:
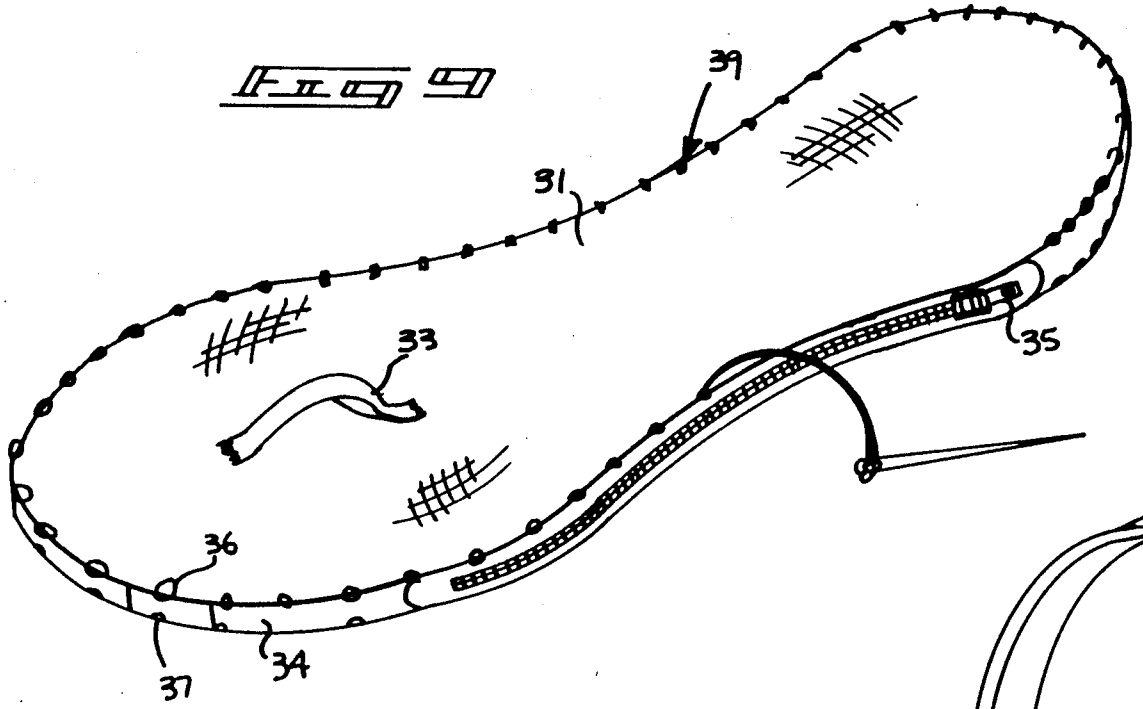
FIG. 9 is an isometric illustration of a removable inserted pocket utilized by the instant invention.

FIG. 9 illustrates the formation of a removable sole pocket 39 wherein a top sole pocket wall 31 overlies and is coextensive with a bottom sole pocket wall 32, wherein the top and bottom pocket walls 31 and 32 are of an identical configuration to that of the sole 16. A continuous side wall 34 is formed between the spaced top and bottom sole pocket walls and utilizes a respective upper and lower side wall seam 36 and 37 that is sewn to secure the side wall 34 to the top and bottom walls, as illustrated. A zipper 35 is sewn into the side wall 34 to provide access to an interior cavity formed by the securement of the side wall 34 to the top and bottom walls 31 and 32. A continuous hook and loop fastener surface 38 is formed to an upper interior surface of the sole 16 to permit selective securement of the sole pocket 39 to the hook and loop fastener surface 38. A loop strip 33 is mounted to a forward portion of the top sole pocket wall 31 and is aligned longitudinally therewith to provide a grasping loop for removal of the pocket selectively by an individual from an interior cavity defined by the formation of the hand bag 10. Further, the support belt 30 is mounted at a forwardmost end to a belt slot strip 29 formed in the creation of the belt slot **29*a* of the tongue 15. Selectively, a forward end of the support belt 30 may be mounted to a forwardmost end of the handbag 10, or selectively to the belt slot strip 29*a*, as illustrated in FIG. 10**, utilizing conventional fasteners (not shown).

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of making a handbag comprising the steps of providing a web of material and subsequently removing a right side shoe silhouette blank and a left side shoe silhouette blank therefrom, wherein the right and left shoe silhouette blanks are formed as mirror images of one another, with a top, bottom and two side edges and subsequently forming an elongate tongue member, comprising a top, bottom and two elongated side edges and securing the two elongated side edges of the tongue member to the topmost edge and one side edge of the right and left silhouette blanks, and forming a sole member, and securing the sole member to the bottommost edges of the right and left blanks, wherein the right and left blanks form acute angles to the sole member and securing the right and left blanks together at a rearwardmost edge of each right and left blank to define a common border, and securing a support belt to a lowermost end of the common border, and to a forwardmost portion of the right and left blanks upon the right and left blanks being sewn together.

2. A method of making a handbag as set forth in claim 1 wherein the common border defines s seam path, the seam path formed to either side of the common border, and wherein the common border is arranged orthogonally relative to the sole member.

3. A method of making a handbag as set forth in claim 2 wherein the formation of the tongue member includes cutting spaced slits, the spaced slits arranged at an acute included angle therebetween and the slits formed adjacent a forwardmost terminal end of the tongue, and the spaced slits receiving forwardmost ends of the right and left blanks thereto, and wherein an elongate tongue seam is sewn to secure the respective right and left sides of the tongue to respective upper ends of the right and left blanks.

4. A method of making a handbag as set forth in claim 3 including the step of forming a continuous hook and loop layer to an upper interior surface of the sole, and forming an elongate sole pocket, the sole pocket coextensive with the hook and loop fastener surface and selectively securable thereto.

5. A method of making a handbag as set forth in claim 4 wherein the formation of the sole pocket includes providing a top sole pocket wall overlying and coextensive with a bottom sole pocket wall, each top and bottom sole pocket walls defining a configuration identical to the sole, and providing a continuous side wall, the side wall sewn to the top and bottom sole pocket walls at respective upper and lower continuous edges of the side wall, and further sewing an elongate zipper into the side wall to provide access to an interior cavity defined by the side wall and the top and bottom sole pocket walls, and providing a flexible strip, and securing the flexible strip to an upper forward surface of the top sole pocket wall to provide manual access to the sole pocket, and positioning the sole pocket to the hook and loop fastener surface.

* * * * *